US006500076B1

(12) United States Patent
Morgan et al.

(10) Patent No.: US 6,500,076 B1
(45) Date of Patent: Dec. 31, 2002

(54) WOUND GOLF BALLS WITH HIGH SPECIFIC GRAVITY CENTERS

(75) Inventors: William E. Morgan, Barrington, RI (US); Douglas E. Jones, Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 46 days.

(21) Appl. No.: 09/845,275

(22) Filed: May 1, 2001

(51) Int. Cl.[7] ..... A63B 37/06; A63B 37/04

(52) U.S. Cl. ..... 473/361; 473/373; 473/357; 473/376

(58) Field of Search ..... 473/351–377

(56) References Cited

U.S. PATENT DOCUMENTS

| | | | | |
|---|---|---|---|---|
| 679,816 | A | | 8/1901 | Alsip |
| 704,748 | A | | 7/1902 | Kempshall |
| 704,838 | A | | 7/1902 | Kempshall |
| 705,249 | A | | 7/1902 | Kempshall |
| 705,359 | A | | 7/1902 | Kempshall |
| 711,177 | A | | 10/1902 | Richards |
| 711,227 | A | | 10/1902 | Richards |
| 711,228 | A | | 10/1902 | Richards |
| 711,229 | A | | 10/1902 | Richards |
| 711,230 | A | | 10/1902 | Richards |
| 714,917 | A | | 12/1902 | Kempshall |
| 716,348 | A | | 12/1902 | Richards |
| 1,255,388 | A | | 2/1918 | Cobb |
| 1,524,171 | A | | 1/1925 | Chatfield |
| 1,946,378 | A | | 2/1934 | Young |
| 2,914,328 | A | | 11/1959 | Harkins |
| RE25,427 | E | | 7/1963 | Harkins |
| 4,995,613 | A | | 2/1991 | Walker |
| 5,104,126 | A | | 4/1992 | Gentiluomo |
| 5,155,157 | A | | 10/1992 | Statz et al. |
| 5,779,562 | A | | 7/1998 | Melvin et al. |
| 5,780,169 | A | | 7/1998 | Hiraoka et al. |
| 5,792,008 | A | * | 8/1998 | Kakiuchi et al. ..... 473/354 |
| 5,984,805 | A | | 11/1999 | Maruko |
| 5,984,806 | A | | 11/1999 | Sullivan et al. |
| 6,015,356 | A | | 1/2000 | Sullivan et al. |
| 6,135,899 | A | * | 10/2000 | Maruko ..... 473/354 |
| 6,149,535 | A | * | 11/2000 | Bissonnette et al. ..... 428/401 |
| 6,227,987 | B1 | * | 5/2001 | Kato ..... 473/357 |
| 6,238,304 | B1 | * | 5/2001 | Scolamiero et al. ..... 473/354 |
| 6,277,034 | B1 | * | 8/2001 | Nesbitt et al. ..... 473/359 |
| 6,319,151 | B1 | * | 11/2001 | Sugimoto ..... 473/356 |
| 6,379,269 | B1 | * | 4/2002 | Nesbitt et al. ..... 473/351 |
| 6,431,999 | B1 | * | 8/2002 | Nesbitt ..... 473/371 |

FOREIGN PATENT DOCUMENTS

| | | |
|---|---|---|
| GB | 2 318 983 A | 5/1998 |

OTHER PUBLICATIONS

Golf Digest, First Flight Ad, May 1958, p. 60.
"Polybutadiene" by J Svetlik, The Vanderbilt Rubber Handbook, p. 89 (1968).
500 Years of Golf Balls History & Collector's Guide, John Hotchkiss, 1997, pp. 46, 51, 67 and 77.

* cited by examiner

*Primary Examiner*—Paul T. Sewell
*Assistant Examiner*—Alvin A. Hunter, Jr.
(74) *Attorney, Agent, or Firm*—Swidler Berlin Shereff Friedman, LLP

(57) ABSTRACT

The present invention is directed towards an improved golf ball that includes a high-specific gravity central sphere encapsulated in a soft and resilient shell layer. The soft-resilient shell may be formed of polybutadiene rubber. This shell is subsequently wound with thread a wound core, which is then covered. The sphere can be formed of a solid metal or molded of high-specific gravity powder retained in a binding material.

41 Claims, 2 Drawing Sheets

WOUND GOLF BALLS WITH HIGH SPECIFIC GRAVITY CENTERS

TECHNICAL FIELD OF THE INVENTION

This invention relates to golf balls and, more particularly, to wound golf balls with high specific gravity centers.

BACKGROUND OF THE INVENTION

Conventional golf balls have been designed to provide particular playing characteristics. These characteristics are generally initial velocity, compression, and spin of the golf ball, and they can be optimized for various types of players. For instance, certain players prefer a ball that has a high spin rate in order to control the ball flight and stop the golf ball on impact with the greens. This type of ball, however, may not provide maximum distance. Other players prefer a ball that has a low spin rate and high resiliency to maximize distance.

Generally, golf balls have been classified as wound balls or solid balls. Wound balls are generally constructed from a liquid or solid center surrounded by an elastic thread wound in tension to form a wound core. This wound core is then surrounded by a cover. Wound balls are generally thought of as performance golf balls. When struck by a golf club, these balls have good resiliency, relatively high spin rate, and "soft" feel. Wound balls are generally more difficult to manufacture than solid golf balls.

Some early solid or non-wound golf balls contained metal. U.S. Pat. No. 4,995,613 to Walker discloses a practice golf ball with a dense metal-containing core surrounded with a thick layer of resilient material. To this, a fabric cover is bound. U.S. Pat. No. 5,104,126 to Gentiluomo discloses a non-wound ball that includes a dense center of steel surrounded by a molded encapsulating mass of a low density resilient synthetic elastomer composition. Both of these patents disclose solid or non-wound balls that include metal.

On the other hand, U.S. Pat. No. 1,946,378 to Young and U.S. Pat. No. 2,914,328 to Harkins disclose golf balls that include wound layers. For example, the Young patent discloses a spherical center weight of metal with an intermediate sphere of soft rubber thereon. Windings of rubber are disposed about the intermediate layer and an outer casing is formed thereon. Since high cis, polybutadiene was first introduced in 1956, the Young patent that was filed in 1931 and issued in 1934, did not disclose the use of such a compound. The commercial product related to the Harkins patent was the First Flight™ golf ball. The Harkins patent does not disclose the use of polybutadiene and the First Flight™ balls were not manufactured using polybutadiene.

TABLE I

Prior Art Steel Centered Golf Balls

| | Inner Sphere | | | Outer Sphere | | Center | |
|---|---|---|---|---|---|---|---|
| Name of Ball Side Stamp | Material | Diameter (in.) | Weight (oz.) | Material | Hardness (Shore D) | Diameter (in.) | Weight (oz.) |
| First Flight Reg 90 Steel Powered Center | steel | 0.343 | 0.096 | NR | 42.5 | 1.034 | 0.549 |
| First Flight Reg 100 Steel Powered Center | steel | 0.343 | 0.097 | NR | 36.1 | 1.057 | 0.541 |
| First Flight 90+ Steel Powered Center Made in USA | steel | 0.342 | 0.096 | SBR & NR | 35.1 | 1.066 | 0.514 |
| Royce Chemical | steel | 0.343 | 0.096 | SBR & NR | 51.1 | 1.005 | 0.514 |
| Steel Flight Steel Center | steel | 0.314 | 0.074 | NR | 30.7 | 1.00 | 0.494 |
| Byron Nelson Steel Center | steel | 0.346 | 0.100 | NR | 24.7 | 1.249 | 0.731 |
| Plymoth Championship Steel Center | steel | 0.343 | 0.097 | SBR & NR | 28.6 | 1.055 | 0.556 |
| Butchart - Nicholls Steel Master Steel Center | steel | 0.343 | 0.096 | SBR & NR | 37.1 | 1.005 | 0.526 |
| Kroydon Steel Center | steel | 0.318 | 0.076 | NR & SBR | 48.1 | 1.24 | 0.720 |
| U.S. Fortune Steel Center | steel | 0.343 | 0.096 | SBR & NR | 34.2 | 1.050 | 0.560 |
| Long Wear Steel Center | steel | 0.348 | 0.102 | NR | 30.3 | 1.220 | 0.724 |
| Bridgestone M H.V. Metallic | steel | 0.345 | 0.097 | NR & SBR | 37.2 | 1.072 | 0.542 |

The balls in Table I are formed with a steel inner sphere surrounded by an outer sphere or shell to form a center. The outer sphere is formed of natural rubber, designated NR, and possibly styrene butadiene rubber, designated SBR. No polybutadiene is used.

In conventional balls, when polybutadiene forms a core layer of the golf ball it typically includes enough high density fillers to alter the weight of such a layer. The amount of high density fillers used is, however, less than about 10 parts per hundred based upon 100 parts per hundred of polybutadiene. These fillers have two unfortunate side effects, they increase the hardness of the center and reduce the ball's resiliency.

Therefore, a need exists for a golf ball with lower hardness or compression but with greater resiliency. The improved golf balls of the present invention to provide as disclosed herein provides such a golf ball.

SUMMARY OF THE INVENTION

The present invention is directed towards an improved golf ball that includes a high-specific gravity central sphere encapsulated in a soft and resilient shell layer.

In one embodiment, the sphere is formed of metal and the soft-resilient shell is formed of polybutadiene rubber molded thereon. This shell is subsequently wound with thread that is preferably elastic to form a wound core. This wound core is then covered. One feature of the metal sphere is that it has a specific gravity of at least about 6.0.

In this embodiment, the sphere has a sphere diameter less than about 0.5 inches and the subassembly with the shell has a shell diameter equal to or greater than about 1.3 inches. Further in this embodiment, the wound core can include a wound core diameter of greater than about 1.55 inches.

Preferably, the inventive golf ball has a compression of less than about 90, and more preferably the compression is between about 40 and about 80.

Preferably, the wound layer is formed of at least one spun elastic thread, and the sphere is formed of a solid metallic material. In this embodiment, the metallic material is formed from one of the following: tungsten, steel, brass, titanium, lead, zinc, copper, iron, silver, platinum, gold, or alloys thereof.

In another embodiment, the sphere is molded of high-specific gravity powder retained in a binding material. Preferably, the binding material is a thermoplastic compound, and the high specific gravity filler is metallic powder. A soft-resilient layer is disposed on the sphere and preferably is formed of polybutadiene rubber molded thereon. This layer is subsequently wound with thread that is preferably elastic to form a wound core. This wound core is then covered.

In yet another embodiment, the binding material can be a thermosetting compound.

According to one feature of this embodiment, the metallic powder is formed from one of the following: steel, brass, titanium, lead, zinc, copper, tungsten, bismuth, nickel, molybdenum, iron, bronze, cobalt, silver, platinum, gold, or alloys thereof. In addition, the sphere has a mass, the metallic powder forms a first percentage of the mass, the binding material forms a second percentage of the mass, and the first percentage is greater than the second percentage.

According to another embodiment, the wound golf ball of the present invention comprises a sphere having a specific gravity of above about 6.0, at least one molded shell, a wound layer, and a cover. The molded shell is formed around the sphere to form a center. The center has a diameter equal to or greater than about 1.25 inches. The wound layer is disposed about the center to form a wound core, and the cover surrounds the wound core.

In alternative embodiments, the center has a diameter of greater than about 1.3 inches or greater than about 1.4 inches.

In this embodiment, the sphere can be formed of a solid metallic material or of metallic powder retained in a binding material.

In yet another embodiment, the center further includes a first shell disposed on the sphere and a second shell disposed on the first shell, wherein the first shell is a molded layer and the second shell is a wound layer. According to one feature of this embodiment, the first shell has a first Shore D hardness and the second shell has a second Shore D hardness different from the first Shore D hardness by at least 5. The first Shore D hardness can be greater than or less than the second Shore D hardness.

The present invention is further directed to a wound golf ball that comprises a solid sphere formed of a metal material, at least one molded shell, at least one wound layer, and a cover. The molded shell is formed around the sphere to form a center. The shell includes a rubber material and has the center has a diameter greater than about 1.25 inches. The wound layer is disposed about the center to form a wound core, and the cover surrounds the wound core.

In one embodiment, the wound layer can be formed of a thread that includes a mixture of synthetic cis-1,4 polyisoprene rubbers, natural rubber and a curing system. Alternatively, the wound layer can be formed of a thread that includes a polyurea material. In another embodiment, the cover is formed of one of the following: balata, gutta percha, an ionomer or a blend of ionomers, polyurethane, polyurea-based composition, epoxy-urethane-based compositions, single site—including metallocene—catalyzed polyolefins, cast elastomers, or combinations thereof.

In another embodiment, the sphere can have a diameter greater than about 0.4 inches, and/or an outer hardness of the wound core is greater than about 55 Shore D.

According to features of the present invention the golf ball cover includes at least two layers. In addition or in the alternative, this golf ball includes at least two wound layers.

DETAILED DESCRIPTION OF THE PREFERRED EMBODIMENTS

Figure 1:
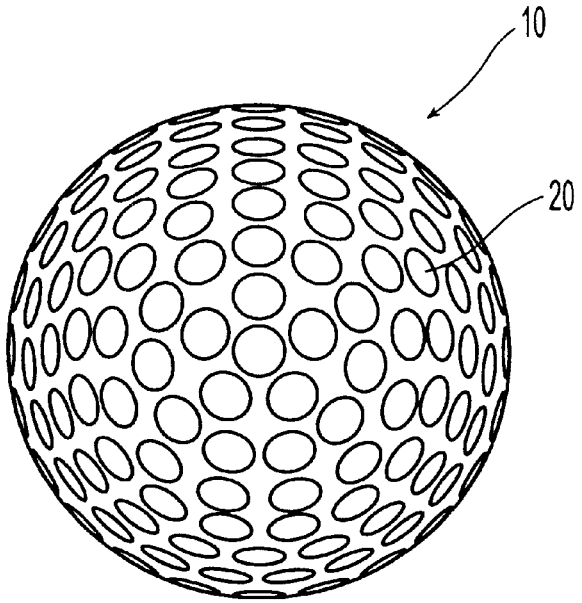
FIG. 1 is an elevational view of a golf ball of the present invention.
Figure 2:
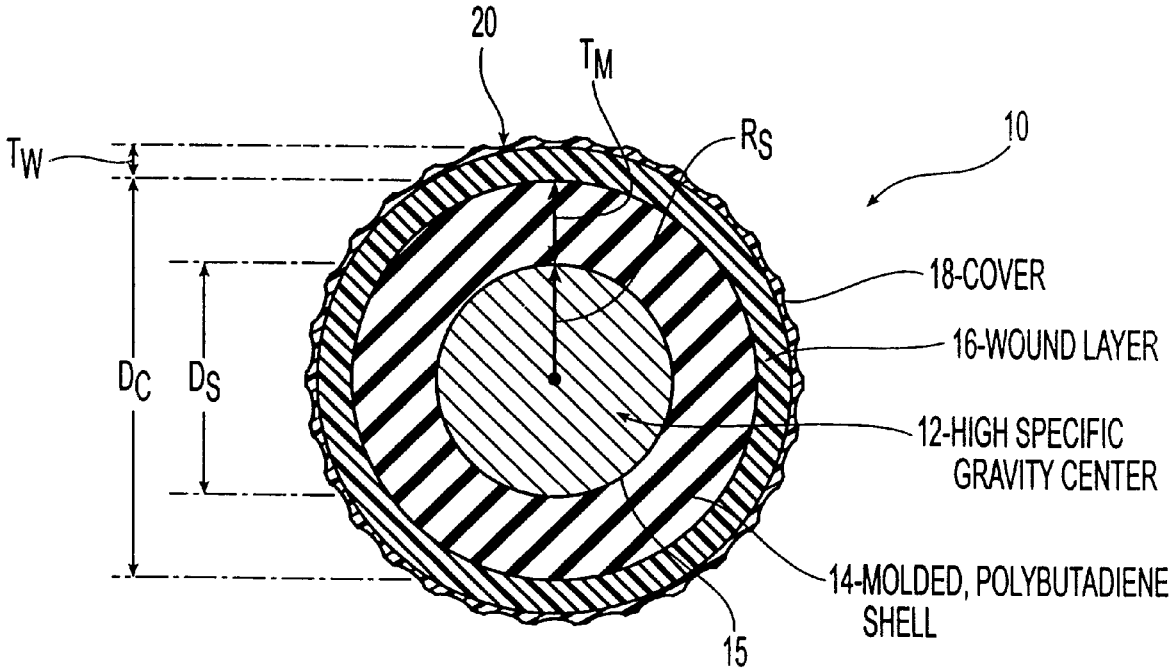
FIG. 2 is a cross-sectional view of the golf ball of FIG. 1.

Referring to FIGS. 1 and 2, a golf ball 10 of the present invention is illustrated that includes a sphere 12 surrounded by a non-wound or molded shell 14 to form a center C. The sphere 12 has an outer surface. The shell 14 is circumferentially continuous and has an inner surface. The shell 14 inner surface and sphere outer surface are in continuous circumferential contact at interface 15. A wound layer 16 of thread is wrapped about the center C adjacent the shell 14. The center C and wound layer 16 form a wound core that is surrounded by a cover layer 18.

It is recommended that the sphere 12 is formed of a high specific gravity material so that the specific gravity is greater than 6.0. The term specific gravity as used in this application is defined in terms of ASTM test specification ASTM D-792–98.

Sphere 12 is solid throughout its diameter. Recommended spheres are commercially available ball bearings such as manufactured by McMaster-Carr of Atlanta, Ga. and Allied Hardware of Far Rockaway, N.Y. The diameter of the sphere can be selected to have a desired influence on various characteristics of the ball, such as the weight distribution of the ball. As a result, the diameter of the sphere can be selected so that the ball's weight is below the USGA maximum.

Referring again to FIG. 2, various dimensions of the golf ball 10 will be discussed. The sphere 12 has a sphere diameter Ds, which is preferably a small diameter. More specifically, the preferred sphere diameter is between about 0.1 inches and about 1.0 inches depending on the metal.

More preferably, the sphere diameter is greater than about 0.1 inches and less than about 0.6 inches. Most preferably, the sphere diameter is between about 0.1 inches and about 0.5 inches. In one embodiment, it is preferred that the sphere diameter is greater than about 0.4 inches.

The more dense the sphere material, the smaller the sphere can be. For example, a sphere of metal having a greater specific gravity, such as tungsten, can be smaller than a sphere of a metal having a lesser specific gravity, such as iron, because in the former the weight is more concentrated, i.e. the desired weight can be attained using less material.

It is preferred that the center C, which includes the sphere 12 and molded shell 14, has a shell or center diameter $D_c$ of equal to or greater than about 1.25 inches. More preferably, the center diameter is greater than about 1.3 inches, and most preferably the center diameter is greater than about 1.4 inches. In some embodiments, the center can have a diameter of greater than about 1.5 inches.

The wound layer 16 has a wound layer thickness of $T_w$. The diameter of the wound core is designated $D_w$ and includes the winding thicknesses $T_w$ and the diameter of the center $D_c$. It is preferred that the wound layer thickness $T_w$ is less than about 15% of the wound core diameter $D_w$. It is also preferred that the molded layer thickness $T_m$ is greater than the wound core thickness $T_w$.

The molded shell 14 is formed of a rubber material. Preferably, the rubber material includes polybutadiene. In one embodiment, the polybutadiene is a high cis polybutadiene with a cis 1,4 content of above about 90% and more preferably above about 96%. Commercial sources of polybutadiene include Shell 1220 manufactured by Shell Chemical, Neocis BR40 manufactured by Enichem Elastomers, and Ubepol BR 150 manufactured by Ube Industries, Ltd. If desired, the polybutadiene can also be mixed with other elastomers known in the art, such as natural rubber, styrene butadiene, and/or isoprene in order to further modify the properties of the core. When a mixture of elastomers is used, the amounts of other constituents in the core composition are based on 100 parts by weight of the total elastomer mixture.

In one embodiment, the polybutadiene component includes a low trans-isomer content, such as about 20%. In another embodiment, the polybutadiene component can include a high trans-isomer content and a low vinyl content. Such as a polybutadiene is disclosed in U.S. patent application No. 09/741,053 filed Dec. 21, 2000, to Bissonnette et al., and entitled "GOLF BALLS INCLUDING RIGID COMPOSITIONS AND METHODS FOR MAKING SAME," which is incorporated by reference in its entirety herein. This patent discloses a polybutadiene that includes at least about 80 percent trans-isomer content with the rest being cis-isomer 1,4-polybutadiene and vinyl-isomer 1 ,2-polybutadiene. The vinyl-content present may be no more than about 15 percent, preferably less than about 10 percent, more preferably less than about 5 percent, and most preferably less than about 3 percent of the polybutadiene isomers, with decreasing amounts being preferred. In one disclosed embodiment, the trans-content can be greater than about 90 percent, in which case the vinyl-content must be present in less than about 10 percent of the polybutadiene isomers.

One useful formulation of polybutadiene includes, in parts by weight based on 100 parts polybutadiene, about 10 to about 30 parts of a metal salt diacrylate, dimethacrylate, or monomethacrylate. Metal salt diacrylates, dimethacrylates, and monomethacrylates suitable for use in this invention include those wherein the metal is magnesium, calcium, zinc, aluminum, sodium, lithium or nickel. Zinc diacrylate (ZDA) is preferred, because it provides golf balls with a high initial velocity in the USGA test. The ZDA can be of various grades of purity. For the purposes of this invention, the lower the quantity of zinc stearate present in the ZDA the higher the ZDA purity. ZDA containing less than about 10% zinc stearate is preferable. More preferable is ZDA containing about 4–8% zinc stearate. Suitable, commercially available ZDA include those from Rockland React-Rite and Sartomer. The preferred concentrations of ZDA that can be used are about 10 to about 30 pph based upon 100 pph of polybutadiene or alternately, polybutadiene with a mixture of other elastomers that equal 100 pph. As used herein, the term "pph" in connection with a batch formulation refers parts by weight of the constituent per hundred parts of the base composition (e.g. elastomer).

Free radical initiators are used with the polybutadiene compound to promote cross-linking of the metal salt diacrylate, dimethacrylate, or monomethacrylate and the polybutadiene. Suitable free radical initiators for use in the invention include, but are not limited to peroxide compounds, such as dicumyl peroxide, 1, I -di (t-butylperoxy) 3,3,5-trimethyl cyclohexane, a-a bis (t-butylperoxy) diisopropylbenzene, 2,5-dimethyl-2,5 di (t-butylperoxy) hexane, or di-t-butyl peroxide, and mixtures thereof. Other useful initiators would be readily apparent to one of ordinary skill in the art without any need for experimentation. The initiator(s) at 100% activity are preferably added in an amount ranging between about 0.05 and 2.5 pph based upon 100 parts of butadiene, or butadiene mixed with one or more other elastomers. More preferably, the amount of initiator added ranges between about 0.15 and 2 pph and most preferably between about 0.25 and 1.5 pph.

An activator such as zinc oxide or calcium oxide in a zinc diacrylate-peroxide cure system that cross-links polybutadiene during the molding process is used. If zinc oxide is used about 2 to about 7 pph of zinc oxide (ZnO) is recommended.

The molded shell material or composition of the present invention preferably minimizes the use of a filler material, such as less than 5 parts per hundred of filler material. Filler material is typically added to the polybutadiene composition to adjust the density and/or specific gravity of the core. As used herein, the term "fillers" includes any compound or composition that can be used to vary the density and other properties of the subject golf ball core. Examples of conventional fillers include mineral fillers, such as zinc oxide, tungsten, clays, and barium sulfate. Preferably, the use of fillers in the shell is minimized to increase resiliency and lower compression, however some filler may be required depending on the desired size and weight of the center.

Antioxidants may also be included in the elastomer cores produced according to the present invention. Antioxidants are compounds which prevent the breakdown of the elastomer. Antioxidants useful in the present invention include, but are not limited to, quinoline type antioxidants, amine type antioxidants, and phenolic type antioxidants.

Other ingredients such as accelerators, e.g. tetra methylthiuram, processing aids, processing oils, plasticizers, dyes and pigments, as well as other additives well known to the skilled artisan may also be used in the present invention in amounts sufficient to achieve the purpose for which they are typically used.

The polybutadiene, ZDA, and activator are mixed together. When a set of predetermined conditions is met, i.e., time and temperature of mixing, the free radical initiator is added in an amount dependent upon the amounts and relative ratios of the starting components, as would be well understood by one of ordinary skill in the art. In particular, as the components are mixed, the resultant shear causes the temperature of the mixture to rise. Peroxide(s) and free radical initiator(s) are blended into the mixture for cross linking purposes in the molding process.

After completion of the mixing, the golf ball shell composition is milled and hand or automatically prepped or extruded into pieces ("preps") suitable for molding. The preps are then compression molded into the shell at an elevated temperature, as discussed below. Typically, 160° C. (320° F.) for 15 minutes is suitable for this purpose.

The shells are molded with a mold that includes a bottom mold plate with mold cavities, a top mold plate with corresponding mold cavities and a single center mold plate with corresponding hemispherical protrusions on each side. The preps are inserted between and aligned with bottom and top mold cavities and the center mold plate is placed there between. The mold is closed and inserted into a press to form the two, non-vulcanized cups from the material. The mold forms the shells into hemispherical cups. Examples of these methods and compositions that can be used are described in U.S. Pat. No. 5,683,312 to Boehm, U.S. Pat. No. 6,096,255 to Brown et al., U.S. Pat. No. 6,172,161 to Bissonnette et al., U.S. Pat. No. 6,180,040 to Ladd et al., U.S. Pat. No. 6,180,722 to Dalton et al., or U.S. patent application Ser. No. 09/375,382 filed Aug. 17, 1999, to Reid Jr. et al. Each of the above patents and application are incorporated by reference in their entirety herein.

The single protrusive mold part is then removed and the sphere 12(as shown in FIG. 2) is inserted into one of the shell cups. The mold is then closed again then placed back into the press, heated and compressed to join the cups and form the shell over the sphere, which forms the center C. An adhesive could be used to secure the spheres within the cups or to join the cups more securely to one another, however the invention is not limited thereto.

Referring to FIG. 2, the wound layer 16 is formed over the shell 14, using conventional winding techniques as known by those of ordinary skill in the art. Preferably, the winding techniques stretch the thread prior to winding the thread onto the shell 14 so that the thread is elongated. The present invention is not limited to winding elongated thread on the shell, and non-elongated thread can also be used.

In addition, the layer 16 can be configured, dimensioned, and formed to create a hoop-stress layer as disclosed in U.S. Pat. No. 5,713,801 to Aoyama, which is incorporated by reference herein in its entirety.

Many different kinds of threads may be used in the ball of the present invention, including both rubber and non-rubber threads. For example, the thread can be formed of a thermoplastic and comprised of a polymeric material, as discussed in detail below.

In one embodiment, the thread material can include polyether urea or a very hard, high-tensile-modulus thread. "Hard, high-tensile-modulus" should be understood herein to mean a tensile modulus of at least about 10,000 ksi.

Thread materials including polyisoprene, polyether urea, polyester, polyethylene, polypropylene, or combinations thereof may be used with the present invention. Relatively high and low modulus threads may be wound simultaneously around a center. Moreover, in another embodiment, a thread that "softens" during the cover compression and/or injection molding process or in a separate process, creating a "mantle" layer or a fused cover layer, such as polyether urea could be used. This is set forth in U.S. application Ser. No. 09/610,608, filed Jul. 5, 2000 and entitled "Golf Balls With a Fused Wound Layer And a Method For Formning Such Balls," which is incorporated by reference herein in its entirety. Also, a thread that does not exhibit softening during molding, such as polyisoprene, may be used with the present invention.

Threads used in the present invention may be formed using a variety of processes including conventional calendering and slitting. Furthermore, processes such as melt spinning, wet spinning, dry spinning or polymerization spinning may also be used to provide threads. Melt spinning is a highly economic process. Polymers are extruded through spinnerets by a heated spin pump. The resulting fibers are drawn off at rates up to 1200 m/min. The fibers are drawn and allowed to solidify and cool in the air. Because of the high temperatures required, only melting and thermally stable polymers can be melt spun. These polymers include poly(olefins), aliphatic polyamides, and aromatic polyesters, all of which are suitable thread materials.

For polymers that decompose on melting, the wet spinning method is used. Solutions of about 5 to 20% are passed through the spinnerets by a spin pump. A precipitation bath is used to coagulate the filaments and a drawing or stretching bath is used to draw the filaments. Filament production rates under this method are lower than melt spinning, typically about 50 to 100 m/min. Because of solvent recovery costs, this method is less economical.

In dry spinning, air is the coagulating bath. The method is usable for polymers that decompose on melting, however only when readily volatile solvents are known for the polymers. Solutions of about 20 to 55% are used. After leaving spinneret orifices, resulting filaments enter a chamber having a length of about 5 to 8 m. In the chamber, jets of warm air are directed toward the filaments. This causes the solvent to evaporate and the filaments to solidify. The process has higher rates of spinning than the wet spinning process. Typically, filament production rates are about 300 to 500 m/min. The initial capital investment of equipment is higher, but the operation costs are lower than in wet spinning. Further, this process is only usable for spinning polymers for which readily volatile solvents are known.

In another method of spinning, polymerization spinning, a monomer is polymerized together with initiators, fillers, pigments, and flame retardants, or other selected additives. The polymerizate is directly spun at rates of about 400 m/min. The polymerizate is not isolated. Only rapidly polymerizing monomers are suitable for this method. For example, LYCRA® is produced by polymerization spinning.

Many different kinds of threads are usable with the present invention. For example, a conventional single-ply golf ball thread can be used. This thread is formed by mixing synthetic cis-polyisoprene rubber, natural rubber and a curing system together, calendering this mixture into a sheet, curing the sheet, and slitting the sheet into threads. The thread is generally rectangular and its dimensions are preferably 0.0625×0.02 inches. The typical area of the thread is generally about 0.0013 $in^2$.

Conventional two-ply golf ball thread is also usable with the present invention. In the case of the two-ply golf ball thread, the mixture and calendering steps are the same as on the single-ply thread. However, after the sheets are thus formed, they are calendered together, cured to bond the plies or sheets together and slit into threads. Each ply of this thread has substantially the same thickness and the same physical properties.

Another two-ply thread usable with the present invention, is formed by the conventional techniques of mixing the thread materials, calendering the thread materials into sheets of the two plies, calendering the sheets or plies together, connecting the plies together, and slitting the sheets into threads. The step of connecting the plies together can be by vulcanizing the material while the two plies are held together under pressure, which will bond the plies together. The vulcanization system is a sulfur bearing system that is activated by heat and known by those of ordinary skill in the art. In one embodiment, the first ply is more resilient and the second ply is more processable, as evidenced by the physical properties of each ply.

Another type of thread usable in the present invention is comprised of many individual filaments or strands. Preferably over 10 strands make up this thread, and more preferably over 50 strands form the thread. Most preferably, the thread contains greater than 100 strands. The strands have a small diameter, typically of a diameter of less than about 0.002 inches, and more preferably less than about 0.0001 inches. Preferably, the strands of have a cross-sectional area of less than about 0.0001 $in^2$ and most preferably less than about 0.00001 $in^2$. Preferably, the thread of this embodiment has a cross-sectional area of less than about 0.001 $in^2$ and most preferably less than about 0.0005 in. Threads formed of multiple strands can be prepared according to the invention by reference to U.S. Pat. No. 6,149,535 to Bissonnette et al., the disclosure of which is hereby incorporated herein by express reference thereto. These strands of the thread may be held together with a binder or they may be spun together. Melt spinning, wet spinning, dry spinning, and polymerization spinning may be used to produce the threads.

Each method has been discussed in more detail herein.

The multi-strand thread preferably includes a polymeric material. Suitable polymers include polyether urea, such as LYCRA®; polyester urea; polyester block copolymers, such as HYTREL®; isotactic-poly(propylene); polyethylene; polyamide; poly(oxymethylene); polyketone; poly(ethylene terephthalate), such as DACRON®; poly(p-phenylene terephthalamide), such as KEVLAR®; poly(acrylonitrile), such as ORLON®; trans,trans-diaminodicyclo- hexylmethane and dodecanedicarboxylic acid, such as QUINA®. LYCRA®, HYTREL®, DACRON®, KEVLAR®, ORLON®, and QUINA® are available from E.I. DuPont de Nemours & Co. of Wilmington, Del. Glass fiber and, for example, S-GLASS® from Corning Corporation can also be used. Also, D7 Globe thread by Globe Manufacturing of Fall River, Mass. can be used. Generally, any thread that can be thermally fused can be used. Indeed, a mixture of any of the thread materials discussed herein can be included in a thread layer of the invention.

The multi-strand thread may also be comprised of strands having different physical properties to achieve desired stretch and elongation characteristics. For example, the thread may include strands of a first elastic type of material that is weak but resilient and also strands of a second elastic type of material that is stronger but less resilient. In another example, the thread may include at least one strand of polyisoprene rubber thread having a diameter of less than about 0.02 inches. This strand may be surrounded by about 10 to 50 polyether urea strands each having a diameter of less than about 0.002 inches. One recommended thread is a spun elastic thread.

Referring again to FIG. 2, the cover 18 is then disposed upon the wound layer 16. The cover 18 is of conventional construction such as balata, gutta percha, an ionomer or a blend of ionomers, polyurethane, polyurea-based composition, epoxy-urethane-based compositions, single site—including metallocene—catalyzed polyolefins, cast elastomers, or a combination of the foregoing.

In addition, the cover layer can be formed of the compositions and constructions as disclosed in U.S. Pat. No. 5,919,100 to Boehm et al., entitled "Fluid or Liquid Filled Non-Wound Golf Ball," which is incorporated by reference in its entirety herein.

An example of a useful ionomer blend is Surlyn®. The cover 18 is formed on the wound core using techniques as know by those of ordinary skill in the art. Examples of these cover forming methods and compositions that can be used are as described in U.S. Pat. No. 5,813,923 to Cavallaro et al., U.S. Pat. No. 5,885,172 to Hebert et al., U.S. Pat. No. 6,083,119 to Sullivan et al., or U.S. Pat. No. 6,132,324 to Hebert et al. Each of the above patents are incorporated by reference in their entirety herein. The cover 18 is preferably formed with dimples 20 therein. In addition, the cover can include a single layer or multiple layers.

Figure 3:
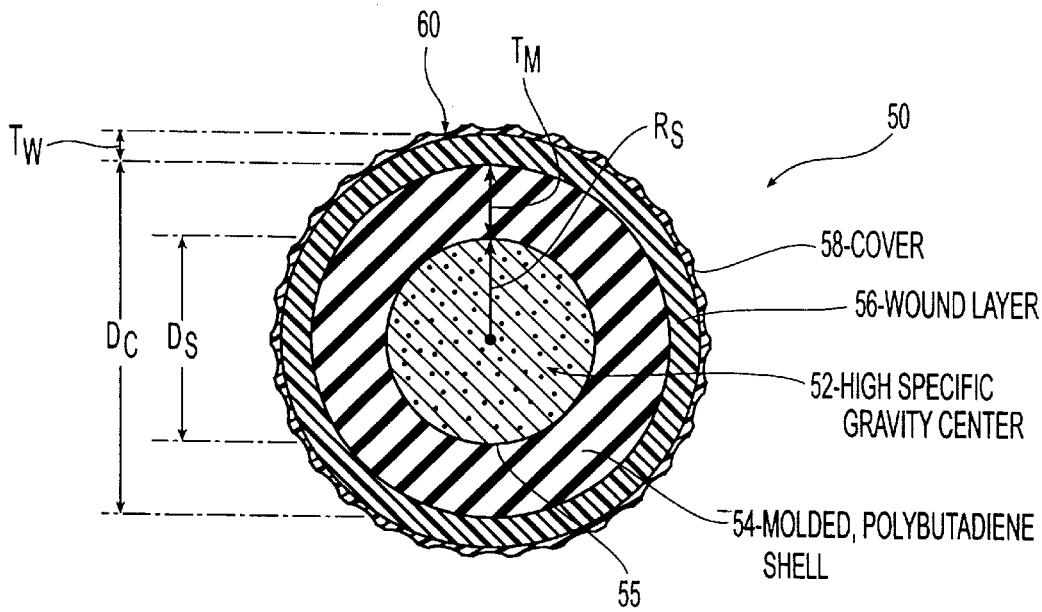
FIG. 3 is a cross-sectional view of another embodiment of a golf ball of the present invention.

Referring to FIG. 3, another embodiment of a golf ball 50 according to the present invention is shown that includes a sphere 52 surrounded by a molded shell 54 to form a center C. A wound layer 56 of thread is wrapped about the center C adjacent the shell 54. The center C and wound layer 56 form a wound core that is surrounded by a cover layer 58. The shell 54, wound layer 56 and cover 58 are formed of the materials and methods as discussed above. The dimensions are preferably the same as those discussed above with regard to FIG. 2.

Sphere 52 is formed as a solid sphere of high specific gravity filler material and a binding material. The particle size of the filler material should be from about 10 mesh to less than about 325 mesh. Small particle size materials are more easily dispersed in a uniform manner within the binding material. Representatives of such high specific gravity filler materials include metal (or metal alloy) powders, such as tungsten powder, but are not limited thereto. Examples of several suitable filler materials which can be included in the present invention and their respective specific gravities are listed in Table II below. Alloys or blends of these filler materials can also be used. It should be noted that the specific gravities in Table II are exemplary and the materials identified can have different specific gravities depending on the specific material used and tested and the materials treatment.

TABLE II

Suitable Filler Materials and Their Specific Gravities

| Type of Powder Filler Material | Specific Gravity |
|---|---|
| tungsten | 19.35 |
| bismuth | 9.78 |
| nickel | 8.90 |
| molybdenum | 10.2 |
| iron | 7.86 |
| copper | 8.94 |
| brass | 8.2–8.4 |
| bronze | 8.70–8.74 |
| cobalt | 8.92 |
| zinc | 7.14 |
| tin | 7.31 |
| lead | 11.35 |
| silver | 10.50 |
| platinum | 21.45 |
| gold | 19.32 |

It is recommended that the binding material used to form sphere 52 is a thermoplastic or thermoset material. Various thermoset materials, such as natural rubber, polybutadiene and golf ball core compositions including polybutadiene can be used. Also, various cover materials, as discussed above, can be used as binding materials.

In this embodiment, the sphere 52 is formed by blending the powder and binding material, then solidifying the mixture by molding. In the sphere formed of powder, the sphere has a mass. The high specific gravity filler or metallic powder forms a first percentage of the mass, the binding material forms a second percentage of the mass, and it is recommended that the first percentage of the mass is greater than the second percentage of the mass. Sphere 52 is formed by injection molding, reaction injection molding, compression molding, transfer molding, casting or the like as known by those skilled in the art.

EXAMPLES

These and other aspects of the present invention may be more fully understood with reference to the following non-limiting examples, which are merely illustrative of the embodiments of the present invention golf ball, and are not to be construed as limiting the invention, the scope of which is defined by the appended claims.

Table III includes examples that show the effect of inner sphere diameter on the golf balls of the present invention and compare these balls to a comparative example.

Table III includes examples that show the effect of inner sphere material on the golf balls of the present invention.

Tables IV and V includes examples that show the effect of center size or shell thickness on the golf balls of the present invention and compare these balls to a comparative example. The inventive balls in Table 4 are wound at lower tension than the inventive balls in Table V.

TABLE III

Effect of Inner Sphere Diameter

| | Inventive Examples | | | | Comparative Example |
|---|---|---|---|---|---|
| Ball Specifications | Ex. 1 | Ex. 2 | Ex. 3 | Ex. 4 | Ex. 1 |
| sphere material | steel | steel | steel | steel | — |
| sphere diameter (in.) | 0.375 | 0.438 | 0.469 | 0.500 | — |
| density of sphere (g/cc) | 7.8 | 7.8 | 7.8 | 7.8 | — |
| center (shell) material | polybutadiene | polybutadiene | polybutadiene | polybutadiene | polybutadiene |
| center (shell) diameter (in.) | 1.3 | 1.3 | 1.3 | 1.3 | 1.3 |
| Ball weight (oz.) | 1.612 | 1.612 | 1.612 | 1.616 | 1.605 |
| Compression | 54 | 49 | 48 | 45 | 89 |
| C of R | .805 | .805 | .806 | .812 | 0.796 |

In Table III, the comparative example is a DT Spin golf ball manufactured by Titleist. This ball has a solid center which lacks a central metallic sphere or significant amount of high-specific gravity (i.e., greater than 6.0 g/cc) material in the center.

The balls of inventive Examples 1–4 include steel central spheres of various diameters and a shell of polybutadiene with 13 pph of ZDA, and 0.55 pph peroxide. Each of the shells are initially provided with 3 pph of zinc oxide, however the specific amount of zinc oxide is varied as needed to make a predetermined ball weight, which is known by one of ordinary skill in the art.

For inventive Examples 1–4 and comparative Example 1, the outer diameter of the shell, the type and amount of thread used, and the cover materials are the same. The shell outer diameter is 1.3 inches.

The thread used for the inventive Examples and comparative Example 1 is two-ply golf ball thread formed by mixing synthetic polyisoprene rubbers, natural rubber and a curing system together, calendering this mixture into a two-ply sheet, curing the sheet, and slitting the sheet into threads. The inventive balls are all molded and finished like comparative Example 1 with a Surlyn® cover.

As used herein, compression is measured using the compression scale based on the ATTI Engineering Compression Tester. The units for such measurements may be referred to as "points" or "compression points." This scale, which is well known to those working in this field, is used in determining the relative compression of a core or ball. Some artisans use the Reihle compression scale instead of the standard compression scale. Based on disclosure in U.S. Pat. No. 5,368,304, column 20, lines 55–53 it appears that Reihle compression values can be converted to compression values through the use of the following equation:

compression value=160−Reihle compression value.

As used herein, "C of R" refers to Coefficient of Restitution, which is obtained by dividing a ball's rebound velocity by its initial (i.e. incoming) velocity. This test is performed by firing the samples out of an air cannon at a steel plate. The C of R values reported herein are the values determined at an incoming velocity of 125 ft/sec.

A perfectly elastic impact has a C of R of one (1), indicating that no energy is lost, while a perfectly inelastic or plastic impact has a C of R of zero, indicating that the colliding bodies did not separate after impact resulting in a maximum loss of energy. A golf ball having a C of R closer to one dissipates a smaller fraction of its total energy when colliding with the plate and rebounding therefrom than does a ball with a lower C of R. Consequently, high C of R values are indicative of greater ball velocity and travel and total distance. It is expected that as the C of R increases the ball flight distance will increase and the maximum total ball distance (i.e., flight distance and roll distance) will increase.

The data in Table III shows that as the diameter of the sphere in the inventive golf balls increases from 0.375 inches (in inventive Example 1) to 0.500 inches (in inventive Example 4) the compression decreases from 54 (in inventive Example 1) to 45 (in inventive Example 4). The data in Table III, also shows that as the diameter of the sphere in the inventive golf balls increases from 0.375 inches (in inventive Example 1) to 0.500 inches (in inventive Example 4) the coefficient of restitution increases from 0.805 (in inventive Example 1) to 0.812 (in inventive Example 4). Thus, as the sphere diameter increases the balls are softer but more resilient, which is desirable.

When the inventive balls are compared to comparative Example 1, the inventive balls have compressions of 54 (in inventive Example 1) to 45 (in inventive Example 4) and comparative Example 1 has a compression of 89. Furthermore, the inventive balls have C of R values from 0.812 (in inventive Example 4) to 0.805 (in inventive Example 1), and comparative Example 1 has a C of R value of 0.796. Thus, the inventive balls have lower compressions than the comparative example and greater coefficients of restitution. Thus, the inventive balls versus to the comparative balls are softer and more resilient, which is desirable.

TABLE IV

Effect of Inner Sphere Material

| Ball | Inventive Example | | | | | |
|---|---|---|---|---|---|---|
| Specifications | Ex. 5 | Ex. 6 | Ex. 7 | Ex. 8 | Ex. 9 | Ex. 10 |
| sphere material | steel | brass | TP and tungsten | TP and tungsten | TS and tungsten | TS and tungsten |
| sphere diameter (in.) | 0.438 | 0.438 | 0.438 | 0.438 | 0.438 | 0.438 |
| s.g. of sphere material | 7.8 | 8.5 | 6 | 11 | 6.3 | 9 |
| Ball weight (oz.) | 1.608 | 1.607 | 1.608 | 1.603 | 1.600 | 1.607 |
| Compression | 51 | 51 | 53 | 46 | 48 | 48 |
| C of R | .806 | .810 | .806 | .811 | .804 | .806 |

For inventive Examples 5 and 6, steel and brass spheres are used, respectively. For inventive Examples 7 and 8, the sphere is formed by binding tungsten powder into a thermoplastic compound in different amounts to vary the specific gravity of each sphere. For inventive Examples 9 and 10, the sphere is formed by binding tungsten powder into a thermoset compound in different amounts to vary the specific gravity of each sphere. The thermoplastic is Pebax® and the thermoset is polybutadiene.

For the balls of inventive Examples 5–10, a shell of polybutadiene has 13 pph of ZDA, and 0.55 pph Trig peroxide. Each of the shells are initially provided with 3 pph of zinc oxide, however the specific amount of zinc oxide is varied as needed to make a predetermined ball weight, which is known by one of ordinary skill in the art. For inventive Examples 5–10, the outer diameter of the shell, the type and amount of thread used, and the cover materials are the same. The shell outer diameter is 1.3 inches. The shell specific gravity was varied through the addition of zinc oxide to hold center weight roughly constant.

The winding for the inventive Examples is done using a thread which is a two-ply golf ball thread formed by mixing synthetic cis-polyisoprene rubbers, natural rubber and a curing system together, calendering this mixture into a two-ply sheet, curing the sheet, and slitting the sheet into threads. The inventive balls are all molded and finished like comparative Example 1 with a Surlyn® cover.

The data in Table IV shows that softer compression and higher C of R obtained in Table III can be accomplished independent of the material composition of the central sphere. It further shows that independent of material higher specific gravity materials are preferable. A solid brass sphere (Ex. 6, specific gravity 8.5) produced a higher C of R ball (0.810) than a solid steel sphere (Ex. 5, specific gravity 7.8) with a C of R of 0.806. Employing a thermoplastic central sphere filled with tungsten powder to a specific gravity of 11 (Ex. 8) produces a higher C of R of 0.81 1 than filling to a specific gravity of 6 (Ex. 7). Similarly, filling a ther*inoset central sphere to a specific gravity of* 9 (Ex. 10) produces a higher C of R of 0.806 than filling a sphere to a specific gravity of 6.3 (Ex. 9) for a C of R of 0.804.

oxide, however the specific amount of zinc oxide is varied as needed to make a predetermined ball weight, which is known by one of ordinary skill in the art. For inventive Examples 11–17 and comparative Example 2, the type and amount of thread used, and the cover materials are the same.

The winding for all of the Examples is the same, using a thread which is a two-ply golf ball thread formed by mixing synthetic cis-polyisoprene rubbers, natural rubber and a curing system together, calendering this mixture into a two-ply sheet, curing the sheet, and slitting the sheet into threads. The inventive balls and comparative Example 2 ball are all molded and finished like comparative Example 1.

The data in Table V shows that the compression of comparative Example 2 is 89 while the inventive Examples 11–17 have compressions of 71 down to an unmeasurably low value obtained for Ex. 17. Table V also shows that the coefficient of restitution of comparative Example 2 is 0.796 while the inventive Examples have coefficients of restitution of 0.775 to 0.8 1 0. Thus, the inventive golf balls of Ex. 11–15 exhibit lower compressions than comparative Example 2. As a result, these inventive golf balls are softer, but as resilient as the ball of Ex. 2, which is desirable.

TABLE VI

Effect of Center Size or Shell Thickness

| Ball Specifications | Inventive Examples Ex. 18 | Ex. 19 | Comparative Ex. 3 |
|---|---|---|---|
| sphere material | steel | steel | — |
| sphere diameter (in.) | 0.438 | 0.438 | — |
| density of sphere material (g/cc) | 7.8 | 7.8 | — |
| center (shell) outer diameter (in.) | 1.305 | 1.400 | 1.3 |
| center (shell) material | poly-butadiene | poly-butadiene | poly-butadiene |
| Ball weight (oz.) | 1.605 | 1.598 | 1.605 |
| Compression | 53 | 36 | 89 |
| C of R | .814 | .803 | .796 |

In Table VI, the comparative Example 3 is a DT Spin, as described above.

TABLE V

Effect of Center Size or Shell Thickness

| Ball Specifications | Inventive Examples Ex. 11 | Ex. 12 | Ex. 13 | Ex. 14 | Ex. 15 | Ex. 16 | Ex. 17 | Comparative Example Ex. 2 |
|---|---|---|---|---|---|---|---|---|
| sphere material | steel | steel | steel | steel | steel | steel | steel | — |
| sphere diameter (in.) | 0.438 | 0.438 | 0.438 | 0.438 | 0.438 | 0.438 | 0.438 | — |
| density of sphere material (g/cc) | 7.8 | 7.8 | 7.8 | 7.8 | 7.8 | 7.8 | 7.8 | — |
| center (shell) outer diameter (in.) | 1.135 | 1.255 | 1.305 | 1.360 | 1.400 | 1.460 | 1.520 | 1.3 |
| center (shell) material | polybutadiene | polybutadiene | polybutadiene | polybutadiene | polybutadiene | polybutadiene | polybutadiene | poly-butadiene |
| ball weight (oz.) | 1.608 | 1.602 | 1.605 | 1.605 | 1.597 | 1.605 | 1.598 | 1.605 |
| compression | 71 | 55 | 47 | 42 | 31 | 11 | low | 89 |
| C of R | .810 | .811 | .801 | .798 | .797 | .788 | .775 | .796 |

In Table V, the comparative example is a DT Spin golf ball manufactured by Titleist, as discussed above.

For the balls of inventive Examples 11–17, a steel sphere is used. Each sphere has the same diameter and density. These spheres are used with a shell that includes a shell of polybutadiene with 13 pph of ZDA, and 0.55 pph peroxide. Each of the shells are initially provided with 3 pph of zinc For the ball of inventive Examples 18 and 19, a steel sphere is used with the same diameter and density. For the ball of inventive Examples 18 and 19, the ball further includes a shell of polybutadiene with 13 pph of ZDA, and 0.55 pph peroxide. Each of the shells are initially provided with 3 pph of zinc oxide, however the specific amount of zinc oxide is varied as needed to make a predetermined ball weight, which is known by one of ordinary skill in the art.

For inventive Examples 18 and 19 and comparative Example 3, the type and amount of thread used, and the cover materials are the same. The thread used for the inventive Examples and comparative Example 3 is two-ply golf ball thread formed by mixing synthetic cis-polyisoprene rubbers, natural rubber and a curing system together, calendering this mixture into a two-ply sheet, curing the sheet, and slitting the sheet into threads. The inventive balls are all molded and finished like comparative Example 1 with a cover of Surlyn®.

The data in Table 5 shows that the compression of comparative Example 3 is 89 while the inventive Examples 18 and 19 have compressions of 53 and 36, respectively. Table 5 also shows that the coefficient of restitution of comparative Example 3 is 0.796 while the inventive Examples 18 and 19 have coefficients of restitution of 0.814 and 0.803, respectively. Thus, the inventive golf balls of Examples 18 and 19 exhibit lower compressions than comparative Example 3 but higher coefficients of restitution. Thus, the inventive Examples 18 and 19 are softer and more resilient balls, which are desirable.

The increasing center size of Ex. 19, though still an embodiment of the invention, does not exhibit an increasing C of R with decreasing compression versus Ex. 18. As noted for Exs. 16 and 17 of Table V and to a lesser extent with Ex. 15 of Table V, the very low compression is detrimentally affecting C of R. Rather than being a dimensional limitation of this invention, one skilled in the art will recognize an opportunity for further C of R increases in center shell formulation and/or winding specifications. While both of these methods would ordinarily produce higher compressions, the already very low compression of Exs. 15, 16, 17 and 19 suggest the opportunity for very high C of R when compressions are increased.

Figure 4:
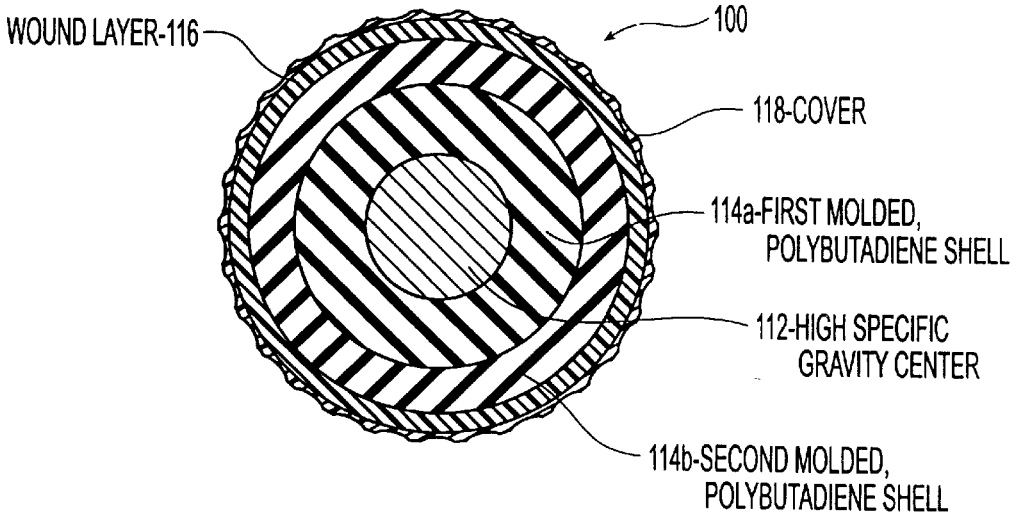
FIG. 4 is a cross-sectional view of an alternative embodiment of a golf ball according to the present invention.

Referring to FIG. 4, an alternative embodiment of a golf ball 100 of the present invention is illustrated that includes a sphere 112 surrounded by a first molded shell 114*a* and a second molded shell 114*b* to form a center C. A wound layer 116 of thread is wrapped about the center C adjacent the shell 114*b*. The center C and wound layer 116 form a wound core that is surrounded by a cover layer 118.

The sphere 112 has a sphere diameter Ds of between about 0.1 inches and about 0.5 inches. The diameter of the center C with the sphere 112 and first molded shell 114*a* is designated $D_{c1}$, and has a value of between about 0.5 inches and about 1.25 inches. The diameter of the center C with the sphere 112, first molded shell 114*a*, and second molded shell 114*b* is designated $DC_2$, and has a value of between about 1.25 inches and about 1.51 inches. Preferably, the wound core diameter $D_w$ has a diameter of greater than about 1.55 inches; most preferably, greater than about 1.565 inches.

The sphere 112, shells 114*a* and 114*b*, wound layer 116 and cover 118 are formed of the materials discussed above. Preferably, the shells 114*a* and 114*b* are formed by the methods and compositions as described in U.S. Pat. No. 6,172,161 to Bissonnette et al., U.S. Pat. No. 6,180,040 to Ladd et al., or U.S. Pat. No. 6,180,722 to Dalton et al. for example. Each of the above patents and application are incorporated by reference in their entirety herein. The wound layer 116 is preferably formed of the material disclosed in U.S. Pat. No. 6,149,535 to Bissonnette et al.

It is further recommended that the first molded shell 114*a* has a first Shore D hardness and the second molded shell 114*b* has a second Shore D hardness different from the first Shore D hardness by at least 5. In one embodiment, the first Shore D hardness is greater than the second Shore D hardness. In an alternative embodiment, the first Shore D hardness is less than the second Shore D hardness. The term Shore D as used in this application is defined in terms of ASTM test specification ASTM D-2240.

When golf balls are prepared according to the invention, they typically will have dimple coverage greater than about 60 percent, preferably greater than about 70 percent, and more preferably greater than about 75 percent. The flexural modulus of the cover on the golf balls, as measured by ASTM method ASTM D-790, is typically greater than about 500 psi, and is preferably from about 500 psi to 150,000 psi. The hardness of the cover is typically from about 35 to 80 Shore D, preferably from about 40 to 78 Shore D, and more preferably from about 45 to 65 Shore D.

The inventive golf balls typically have a coefficient of restitution of greater than about 0.7, preferably greater than about 0.75, more preferably greater than about 0.78, and most preferably greater than about 0.8. The inventive golf balls also typically have a compression of less than 90, and more preferably the compression is between about 40 and about 80.

While it is apparent that the invention herein disclosed is well calculated to fulfill the objects above stated, it will be appreciated that modifications and embodiments may be devised by those skilled in the art. The embodiments above can also be modified so that some features of one embodiment are used with the features of another embodiment. It is intended that the appended claims cover all such modification and embodiments as fall within the true spirit and scope of the present invention.

What is claimed is:

1. A wound golfball comprising;

a) a sphere having a specific gravity of at least about 6.0;

b) at least one molded shell being formed around the sphere of polybutadiene material to form a center;

c) a wound layer disposed about the center to form a wound core, wherein the wound layer is formed of at least one spun elastic thread; and d) a cover surrounding the wound core.

2. The wound golf ball of claim 1, further including a compression of less than about 90.

3. The wound golf ball of claim 2, wherein the compression is between about 40 and about 80.

4. The wound golf ball of claim 3, further including a coefficient of restitution of greater than about 0.8.

5. The wound golf ball of claim 1, further including a coefficient of restitution of greater than about 0.7.

6. The golf ball of claim 1, wherein the sphere has a sphere diameter less than about 0.5 inches and the shell has a shell diameter equal to or greater than about 1.3 inches.

7. The golf ball of claim 1, wherein the wound core has a wound core diameter of greater than about 1.55 inches.

8. The golf ball of claim 1, wherein the sphere is formed of a solid metallic material.

9. The golf ball of claim 8, wherein the metallic material is formed from one of the following: tungsten, steel, brass, titanium, lead, zinc, copper, iron, silver, platinum, gold, or alloys thereof.

10. The golf ball of claim 1, wherein the sphere is formed of high specific gravity filler retained in a binding material.

11. The golf ball of claim 10, wherein the binding material is a thermoplastic or thermoset material.

12. The golf ball of claim 10, wherein the high specific gravity filler is metallic powder.

13. The golf ball of claim 12, wherein the metallic powder is formed from one of the following: tungsten, steel, brass, titanium, lead, zinc, copper, bismuth, nickel, molybdenum, iron, bronze, cobalt, silver, platinum, gold, or alloys thereof.

14. The golf ball of claim 12, wherein the sphere has a mass, the metallic powder forms a first percentage of the mass, the binding material forms a second percentage of the mass, and the first percentage is greater than the second percentage.

15. The golf ball of claim 1, wherein the polybutadiene material has a cis 1,4 content of above about 90%.

16. The golf ball of claim 1, wherein the molded shell includes less than 10 parts per hundred of a filler material exclusive of activator.

17. The wound golf ball of claim 1, wherein the cover is formed of polyurethane.

18. The wound golf ball of claim 17, wherein the cover includes at least two layers.

19. A wound golf ball comprising:

a) a sphere having a specific gravity above about 6.0;

b) a first shell having a first shore D hardness formed around the sphere and a second shell having a second shore D hardness disposed on the first shell to form a center having a diameter equal to or greater than about 1.25 inches, wherein the first shell is a molded layer and the second shell is a wound layer, and wherein the first shell, and wherein the hardness of the first and second shells differ by at lcast 5 shore D;

c) a wound layer disposed about the center to form a wound core; and d) a cover surrounding the wound core.

20. The golf ball of claim 19, wherein the center has a diameter of greater than about 1.3 inches.

21. The golf ball of claim 19, wherein the center has a diameter greater than about 1.4 inches.

22. The golf ball of claim 19, wherein the sphere is selected from the group consisting of: a solid metallic material or a metallic powder retained in a binding material.

23. The golf ball of claim 19, wherein the first shore D hardness is greater than the second shore D hardness.

24. The golf ball of claim 19, wherein the first shore D hardness is less than the second shore D hardness.

25. A wound golf ball comprising, a) a sphere having a specific gravity of about 6.0;

b) at least one molded shell by formed around the sphere to form a center, said center having a diameter equal to or greater than about 1.25 inches;

c) a wound layer disposed about the center to form a wound core; and d) a cover surrounding the wound core, wherein the at least one molded shell is formed of a polybutadiene material selected from the group consisting of: polybutadiene with a cis 1,4 content of above about 90% or polybutadiene with a trans-isomer content of about 20%.

26. The golfball of claim 25, wherein the center has a diameter of greater than about 1.3 inches.

27. The golf ball of claim 25, wherein the sphere is formed of a solid metallic material.

28. The golf ball of claim 25, wherein the sphere is formed of a high specific gravity filler retained in a binding material.

29. A wound golf ball comprising:

a) a solid sphere formed of a metal material;

b) at least one molded shell being formed around the sphere to form a center, said molded shell being formed of a rubber material, wherein the center has a diameter greater than about 1.25 inches;

c) at least one wound layer disposed about the center to form a wound core, said wound layer having at least one thread comprising polyurea; and d) a cover surrounding the wound core.

30. The wound golf ball of claim 29, wherein the wound layer comprises a thread formed of a mixture of synthetic cis-polyisoprenc rubbers, natural rubber and a curing system.

31. The wound golf ball of claim 29, wherein the cover is formed of one of the following: balata, gutta percha, an ionomer or a blend of ionomers, polyurethane, polyurea-based composition, epoxy-urethane-based compositions, metallocene-catalyzed polyolefins, cast elastomers, or combinations thereof.

32. The wound golf ball of claim 29, wherein the cover includes at least two layers.

33. The wound golf ball of claim 29, further including at least two wound layers.

34. The wound golf ball of claim 29, wherein the sphere has a diameter greater than about 0.4 inches.

35. A wound golf ball comprising:

a) a solid sphere formed of a metal material;

b) at least one molded shell being formed around the sphere to form a center, said molded shell being formed of a rubber material, wherein the center has a diameter greater than about 125 inches;

c) at least one wound layer disposed about the center to form a wound core, and d) a cover surrounding the wound core, wherein the outer hardness of the wound core is greater than about 55 shore D.

36. The golf ball of claim 35, wherein the wound layer comprises a thread formed of a mixture of synthetic cis-polyisoprcne rubbers, natural rubber, and a curring system.

37. The golf ball of claim 35, wherein the wound layer comprises a thread formed of polyurea.

38. The golf ball of claim 35, wherein the cover comprises at least two layers.

39. The golf ball of claim 35, wherein the golf ball has a compression of less than about 90.

40. The golf ball of claim 35, wherein the golf ball has a coefficient of restitution of greater than about 0.7.

41. The golf ball of claim 35, wherein the wound layer is formed of at least one spun elastic tbread.

* * * * *

UNITED STATES PATENT AND TRADEMARK OFFICE

CERTIFICATE OF CORRECTION

PATENT NO. : 6,500,076 B1 
DATED : December 31, 2002
INVENTOR(S) : William E. Morgan and Douglas E. Jones It is certified that error appears in the above-identified patent and that said Letters Patent is hereby corrected as shown below:

Column 16,
Lines 30-37, claim 1, should read as:

1. A wound golf ball comprising;

a) a sphere having a specific gravity of at least about 6.0;

b) at least one molded shell being formed around the sphere of polybutadiene material to form a center;

c) a wound layer disposed about the center to form a wound core, wherein the wound layer is formed of at least one spun elastic thread; and d) a cover surrounding the wound core.

Column 18,
Lines 31-42, claim 35, should read as:

35. A wound golf ball comprising:

a) a solid sphere formed of a metal material;

b) at least one molded shell being formed around the sphere to form a center, said molded shell being formed of a rubber material, wherein the center has a diameter greater than about 1.25 inches;

c) at least one wound layer disposed about the center to form a wound core, and d) a cover surrounding the wound core, wherein the outer hardness of the wound core is greater than about 55, shore D.

UNITED STATES PATENT AND TRADEMARK OFFICE

CERTIFICATE OF CORRECTION

PATENT NO. : 6,500,076 B1 
DATED : December 31, 2002
INVENTOR(S) : William E. Morgan and Douglas E. Jones It is certified that error appears in the above-identified patent and that said Letters Patent is hereby corrected as shown below:

Column 18 (cont'd),
Lines 53-54, claim 41, should read as:

41. The golf ball of claim 35, wherein the wound layer is formed of at least one spun elastic thread.

Signed and Sealed this

Twenty-first Day of June, 2005

JON W. DUDAS
*Director of the United States Patent and Trademark Office*

UNITED STATES PATENT AND TRADEMARK OFFICE

CERTIFICATE OF CORRECTION

PATENT NO. : 6,500,076 B1 
DATED : December 31, 2002
INVENTOR(S) : William E. Morgan and Douglas E. Jones It is certified that error appears in the above-identified patent and that said Letters Patent is hereby corrected as shown below:

Column 16,
Lines 30-37, claim 1, should read as:

1. A wound golf ball comprising;

a) a sphere having a specific gravity of at least about 6.0;

b) at least one molded shell being formed around the sphere of polybutadiene material to form a center;

c) a wound layer disposed about the center to form a wound core, wherein the wound layer is formed of at least one spun elastic thread; and d) a cover surrounding the wound core.

Column 18,
Lines 31-42, claim 35, should read as:

35. A wound golf ball comprising:

a) a solid sphere formed of a metal material;

b) at least one molded shell being formed around the sphere to form a center, said molded shell being formed of a rubber material, wherein the center has a diameter greater than about 1.25 inches;

c) at least one wound layer disposed about the center to form a wound core, and d) a cover surrounding the wound core, wherein the outer hardness of the wound core is greater than about 55 shore D.

UNITED STATES PATENT AND TRADEMARK OFFICE

CERTIFICATE OF CORRECTION

PATENT NO. : 6,500,076 B1
DATED : December 31, 2002
INVENTOR(S) : William E. Morgan and Douglas E. Jones It is certified that error appears in the above-identified patent and that said Letters Patent is hereby corrected as shown below:

Column 18 (cont'd),
Lines 53-54, claim 41, should read as:

41. The golf ball of claim 35, wherein the wound layer is formed of at least one spun elastic thread.

This certificate supersedes Certificate of Correction issued June 21, 2005.

Signed and Sealed this

Thirty-first Day of January, 2006

JON W. DUDAS
*Director of the United States Patent and Trademark Office*